United States Patent [19]

Haskell et al.

[11] Patent Number: 4,634,516

[45] Date of Patent: Jan. 6, 1987

[54] SLURRY TREATMENT OF A GAS OIL OR KEROSENE FEED STOCK FOR A STEAM CRACKING PROCEDURE

[75] Inventors: Weston W. Haskell; Danny Y. Ngan, both of Houston, Tex.

[73] Assignee: Shell Oil Company, Houston, Tex.

[21] Appl. No.: 800,850

[22] Filed: Nov. 22, 1985

[51] Int. Cl.[4] ..... C10G 25/06; C10G 55/04

[52] U.S. Cl. ..... 208/91; 208/48 R; 208/106; 208/177; 208/298; 208/310 R

[58] Field of Search ..... 208/91, 48 R, 299, 300, 208/177, 85, 48 AA, 310 R, 106, 298, 301; 502/518, 515

[56] References Cited

U.S. PATENT DOCUMENTS

| | | | |
|---|---|---|---|
| 1,683,193 | 9/1928 | Isom et al. | 208/81 |
| 1,807,242 | 5/1931 | Isom | 208/91 |
| 2,632,727 | 3/1953 | Lanneau et al. | 208/91 |
| 3,063,934 | 11/1962 | Epperly et al. | 208/91 |
| 3,340,316 | 9/1967 | Wacker et al. | 208/310 R |
| 3,513,089 | 5/1970 | Geach et al. | 208/28 |
| 3,546,316 | 12/1970 | Koszman | 208/91 |
| 3,689,404 | 9/1972 | Hofer et al. | 208/310 R |
| 3,767,563 | 10/1973 | Woodle | 208/85 |
| 4,201,665 | 5/1980 | Savage et al. | 210/673 |
| 4,225,319 | 9/1980 | Thomas | 208/299 |
| 4,370,221 | 1/1983 | Patmore et al. | 208/112 |
| 4,406,772 | 9/1983 | Sasaki et al. | 208/112 |
| 4,410,421 | 10/1983 | Atherton et al. | 108/254 R |
| 4,411,768 | 10/1983 | Unger et al. | 208/299 |
| 4,447,315 | 5/1984 | Lamb et al. | 208/310 R |
| 4,521,299 | 6/1985 | Givens et al. | 208/254 R |
| 4,559,133 | 12/1985 | Siegfried et al. | 208/177 |

*Primary Examiner*—Andrew H. Metz
*Assistant Examiner*—Anthony McFarlane
*Attorney, Agent, or Firm*—Kimbley L. Muller

[57] ABSTRACT

A process is disclosed for deactivating or removing aromatic compounds from a kerosene or gas oil, which aromatics are coke precursors in a steam cracking process (conducted in the absence of a catalyst) to convert the hydrocarbons contained in the kerosene or gas oil to hydrocarbons of smaller molecules. The excising occurs by contacting the kerosene or gas oil, before admission to the steam cracking zone, with particulate size activated carbon of 4 mesh to 50 mesh size and physically removing the activated carbon (with at least a portion of the aromatic content of the coke derived from the kerosene or gas oil absorbed thereon) from the slurry before passage of the kerosene or gas oil to the steam cracking furnace. The separation of the activated carbon from the kerosene or gas oil is made in a physical separation zone whereby a wall having aperatures therein, similar to a filter or screen, is sized to permit passage of the kerosene or gas oil through the aperatures with a decreased amount of aromatics and yet prohibit the passage of the fine, particulate activated carbon having polynuclear aromatics absorbed through the aperatures thereon.

7 Claims, 1 Drawing Figure

SLURRY TREATMENT OF A GAS OIL OR KEROSENE FEED STOCK FOR A STEAM CRACKING PROCEDURE

FIELD OF THE INVENTION

A gas oil feedstock is defined as a petroleum distillate with a viscosity and boiling range between kerosene and lubricating oil. While this invention may be viable and equivalent to other boiling range hydrocarbon material such as kerosene, it is preferred that the feedstock of this process is a gas oil which has been derived from a crude oil mineral as a straight run gas oil or as a selectively hydrocracked gas oil.

Hydrocarbon streams derived from a crude mineral oil can be cracked in the presence of steam so as to arrive at a hydrocarbon product having smaller molecules. It is desired to thermally convert, without the presence of a catalyst, a gas oil feedstream to a gasoline boiling range material for fuel to be used for internal combustion engines. One problem confronting pyrolytic conversion of a gas oil is the unwanted build-up of coke in a steam cracking reactor. One method of reducing the coking potential of gas oil feed stocks to a steam cracking unit is to employ severe hydrotreating to remove heterocyclic nitrogen and sulfur compounds which tend to encourage coke formation. It is also possible, as shown in U.S. Pat. Nos. 4,521,299 and 4,410,421, to utilize coal particles to sorb a substantial portion of basic nitrogen compounds contained in petroleum or petroleum derived liquids, shale oil, shale-derived liquids or the like.

In many steam thermal cracking furnaces a gas oil feed stock can be converted to corresponding olefin material which is utilized in many chemical manufacture procedures and in the processing of gasoline via different isomerization and hydrogenation reactions. The advantage of this invention is the unexpected large reduction in the quantity of residual coke deposited within the cracking furnace during gas oil cracking thereby eliminating premature shutdown of the gas oil cracking furnace and increasing the productivity of olefins.

BACKGROUND OF THE INVENTION

Above-mentioned U.S. Pat. No. 4,410,421 issued to Atherton et al, concerns a hydrocarbonaceous material which is contacted with particulate coal to cause the coal to adsorb a substantial portion of the basic nitrogen compounds contained in the hydrocarbonaceous material. This invention was developed to eliminate the pollutant $NO_x$ resultant from the burning of the petroleum or petroleum-derived liquids and the like in a combustion furnace (such as a public utility). It is recognized that these feed materials contain naphthalene, methylnaphthalene, phenathrene and pyrene. The patentees sole experiment teaches that an admixture of tetrahydroquinoline (THQ) was removed from the hydrocarbonaceous liquid 1-methylnaphthalene by contact with various Indiana and Kentucky coals. In Givens et al, U.S. Pat. No. 4,521,299 a similar method is proposed whereby anthracite coal is treated with air, oxygen or an oxygen-enriched air to activate and form on the surface carboxyclic acid moiety complexing sites which enhance the removal of basic heterocyclic nitrogen compounds from a petroleum fuel feedstock. The patentees teach that alcohols, ethers and aromatic materials, including fused ring systems, with or without branch chains, can be employed as solvents or carriers during denitrogenation.

In 1973, U.S. Pat. No. 3,767,563 issued to Woodle for a process for converting a hydrocarbon catalytically without interference from components detrimental to the catalyst. The presence of aromatic hydrocarbons in the catalytic cracking of waxy paraffinic hydrocarbons is known as an interferant in catalytic cracking. In fact, the presence of the same will result in a higher temperature necessary in order to obtain the desired low pour point temperature of the resultant lubricating oil fraction. While the generic description of the patentees invention is applicable to catalytic, as well as non-catalytic reactions, the very purpose for removing the nefarious components is to preserve conversion without an increase in temperature as a result of catalyst deactivation. The solid absorbents contemplated include activated carbon. The solid sorbents sorb the troublesome compounds, such as aromatics, and are subsequently desorbed by the effluent downstream of the reaction zone. In Unger et al, U.S. Pat. No. 4,411,768, a hydrogenation operation has contained therein a calcined coke particulate bed to eliminate coke precursors from the recycle stream. First, the hydrogenation effluent is cooled to a temperature of 350° to 600° F. before the coke precursors, which are characterized as being toluene and heptane insolubles, are precipitated from the liquid recycle.

In Isom et al, U.S. Pat. No. 1,683,193 oil is heated by repeated circulation at relatively high velocities to provide for uniform heating in a crude petroleum oil distillation system. A bed of finely divided adsorbent or filtering material is maintained within the body of the oil so that the circulating oil is repeatedly passed through the bed of material. A similar disclosure is also made in U.S. Pat. No. 1,807,242 issued to Isom.

The prior art above discussed fails to disclose the use of fine particulate activated carbon material to remove aromatic compounds and particularly multi-ring aromatic compounds from a gas oil feed material with a physical separation step contemplated prior to entry of the feed material to a thermal cracking zone.

OBJECTS AND EMBODIMENTS OF THE INVENTION

An object of this invention is to provide a feasible means to extract aromatic compounds from a gas oil feed material which is to be passed to a steam thermal cracking unit for the pyrolytic conversion of the gas oil to olefinic material.

Another object of this invention is to provide an easy, feasible and economic process to eliminate coke precursor compounds from a gas oil feed material which is then in better condition to undergo steam thermal cracking.

Yet another object of this invention is to remove multi-ring polynuclear aromatics, such as naphthalenes and anthracenes from a hydrocarbon petroleum derived distillate, such as a gas oil or kerosene, in a manner such that fine activated carbon particles, in a slurry with the gas oil, can adsorb the aromatics and then can be regenerated in the presence of steam and carbon dioxide for reuse in the sorbing slurry once again.

Another object of this invention is to provide a removal system whereby aromatic compounds (absorbed on fine, activated carbon particles) are physically removed from a gas feed oil feed stream by a physical screening process before passage of the gas oil to a thermal cracking unit having steam present therein.

One embodiment of this invention resides in a process for deactivating coke precursors in a gas oil suitable for steam cracking of said gas oil feed to crack hydrocarbons contained therein to hydrocarbons of smaller molecules, which process comprises contacting said gas oil, at contacting conditions, in a slurry with fine particle size activated carbon, mixing said slurry in the presence of a mixing means to permit at least a portion of said coke precursors in said gas oil to adsorb into the activated carbon over a select period of time, passing said slurry to a separation zone wherein said activated carbon with said coke precursors thereon are physically separated from said gas oil to produce a gas oil feed stock with a diminished quantity of coke precursors and passing said gas oil feed stock with diminished quantities of coke precursors to a steam cracking zone for said cracking of said gas oil.

Yet another embodiment of this invention resides in a process for the steam cracking of a gas oil, at steam cracking conditions, to produce a hydrocarbon material having smaller molecules than the molecules present in said gas oil, the improvement which consists of treating said gas oil with activated carbon particles in a slurry having activated carbon in particle size of from 4 mesh to 50 mesh and physically separating said activated carbon from said slurry prior to steam cracking of said gas oil.

Yet another embodiment of this invention resides in a process for the steam cracking, in a steam cracking zone, of a gas oil having coke precursors therein which comprises: passing said gas oil with said coke precursors therein to a slurry mix tank at a temperature of from about 10° C. to about 50° C. at slurry forming conditions with activated carbon present in a particle size of from about 4 mesh to about 50 mesh; slurrying said gas oil with said activated carbon for a period of time sufficient to transfer at least a portion of said coke precursors from said gas oil to said activated carbon; passing said slurry containing said gas oil of diminished coke precursor content and said activated carbon of enhanced coke precursor content to a separation zone for the physical separation of said gas oil from said activated carbon; and passing said separated gas oil to said steam cracking zone to crack said gas oil to said hydrocarbon product of smaller molecules.

BRIEF DESCRIPTION OF THE INVENTION

This invention involves forming a slurry of: (1) a gas oil or kerosene hydrocarbon with (2) fine particle size activated carbon so as to absorb at least a portion of the polynuclear aromatics within said hydrocarbon onto the activated carbon. The latter is then excised from the process in a physical separation zone before the gas oil or kerosene hydrocarbon is passed to a thermal cracking unit having steam attainment means.

DETAILED DESCRIPTION OF THE INVENTION

While this invention is applicable to different feed materials, it is preferred that a gas oil or a kerosene hydrocarbon distillate, which is to undergo steam hydrocracking to convert same to olefins, is utilized as the feed material. Such a hydrocarbonaceous feed material will have a boiling point of at least kerosene range and be lower than the boiling point range of a lubricating oil hydrocarbon. Regardless of how this gas oil or kerosene hydrocarbon is derived, the same will have indigenous thereto different aromatic compounds, which are coke precursors in steam thermal cracking. These aromatic compounds can be represented by the formula: $C_nH_{2n+z}$ where the single ring aromatics range from $Z=-6$ to $-10$; two-ringed aromatics range from $Z=-10$ to $-16$; three-ringed aromatics range from $Z=-16$ to $-20$; and four-and higher ringed aromatics are represented by $Z=-20$ and higher and wherein n is equal to 14 or greater. Of particular nefarious qualities in regard to coke forming are the polynuclear aromatics, particularly those within the range of $Z=-16$ to $-24$. Surprisingly, it has been found that an activated fine particle size carbon-slurried with the gas oil or kerosene hydrocarbon will greatly excise these aromatic compounds prior to steam cracking.

The excised aromatic compounds are selectively adsorbed on the activated carbon particles. As shown in FIG. 1 hereinafter discussed, these particles are removed via a physical separation step previous to entry of the gas oil to a steam cracker unit. During adsorption, the slurry is formed in a mixing means which comprises a vessel suitable for maintaining the slurry of activated carbon particles and gas oil or kerosene hydrocarbon distillate. This vessel may be as simple as a conduit with ejection means or it may be an upright vessel of substantial internal volume with a uniform or variable stirring mechanism means in the bottom, top or intermediate section thereof. After the slurry has been formed and the activated carbon particles have sorbed the sought after polynuclear aromatic compounds, a separation means physically excises the activated carbon having an enhanced amount of polynuclear aromatic compounds from the gas oil or kerosene hydrocarbon, which has a decreased amount of same. It is preferred that the physical separation means be contained in a separation zone comprising at least one and preferably a multitude of perforated walls having apertures therein designed for elution of the gas oil or kerosene through the appropriately sized apertures while prohibiting passage of the activated carbon particles therethrough. One viable means of separation is selective placement of a screen or sieve having openings between 4 mesh and 50 mesh and preferably sized at 50 mesh openings (the smallest openings possible to prevent any passage of the sorbed aromatic-containing activated carbon through the screen or sieve to the steam cracker).

The fine particle size activated carbon is present in a size as large as 4 mesh and as small as 50 mesh. The relative surface area of the activated carbon increases as the particle sizes become smaller. It may be advantageous to treat the surface area of the activated carbon particles with an aromatic attracting agent such as air, an alcohol or a carboxylic acid. It is preferred that the activated carbon particles be present in a particle size of from about 4 mesh to about 10 mesh although particles as small as 10 mesh to 50 mesh are contemplated within this invention. In fact, the only limiting factor on the size of the activated carbon particles is the number of viable perforations necessary in the wire mesh filter or screen to provide an adequate throughput of the gas oil or kerosene to the steam cracker while preventing undue rapid clogging of the filter or screen element. The activated carbon may be derived from charcoal or a natural source of carbon such as coal (preferably subbituminous coal).

The conditions in the mixing means prevalent during the sorption of the polynuclear aromatic compounds onto the activated carbon particles comprise a temperature of from about 10° C. to about 50° C. at a pressure of from about 1 atmosphere to about 100 atmospheres. The duration of the slurry should be from about 5 minutes to about 1 minute with proper agitation so as to attain transmission of the aromatic and polynuclear aromatic constituency of the gas oil or kerosene to the activated carbon particles.

After passing through the wire mesh filter element, the gas oil or kerosene, usually having a boiling point of from 200° to 500° C., will be cracked in the presence of steam in a thermal cracking furnace. This prolytic cracking is undertaken with a reduced amount of coke formation resultant from the sorption of the aromatic compounds on the removed fine particle size activated carbon. The gas oil or kerosene is preferably cracked to its olefin counterpart which can be used in the manufacture of various chemicals or can be isomerized and saturated to a gasoline boiling range hydrocarbon. The cracking conditions existent during steam cracking are usually a temperature of from about 850° C. to about 1400° C., a pressure of about 1 atmosphere to about 100 atmospheres and a ratio of steam to hydrocarbon of about 1:1 to about 1:10.

It is contemplated that more than one wire mesh filter screening unit be utilized to excise the activated carbon particles from the gas oil or kerosene. It is preferred that these screen mesh units be arranged in parallel flow passage to permit the use of one such unit while a second unit is being regenerated by means of steam and carbon dioxide to eliminate the screen of plugged solid particles which were too large to penetrate the selective aperatures in the screen or filter. In operation, the screens, once found to be inoperative because of large pressure drop, are taken off line and the flow of gas oil (plus activated carbon particles containing the aromatic compounds) are channeled to another fungible new or regenerated filter unit. The spent or inoperative unit is then contacted with first steam at a temperature of over 100° C. and a pressure of from 1 to 50 atmospheres to adequately remove the clogged carbon particles therefrom. Thereafter, contact is made with carbon dioxide at a temperature of from about 25° C. to about 250° C. and a pressure of from about 1 atmosphere to about 50 atmospheres to complete removal of the activated carbon particles. It is also contemplated that the steam and carbon dioxide treatment may be undertaken concomitantly.

DETAILED DESCRIPTION OF THE INVENTION

Figure 1:
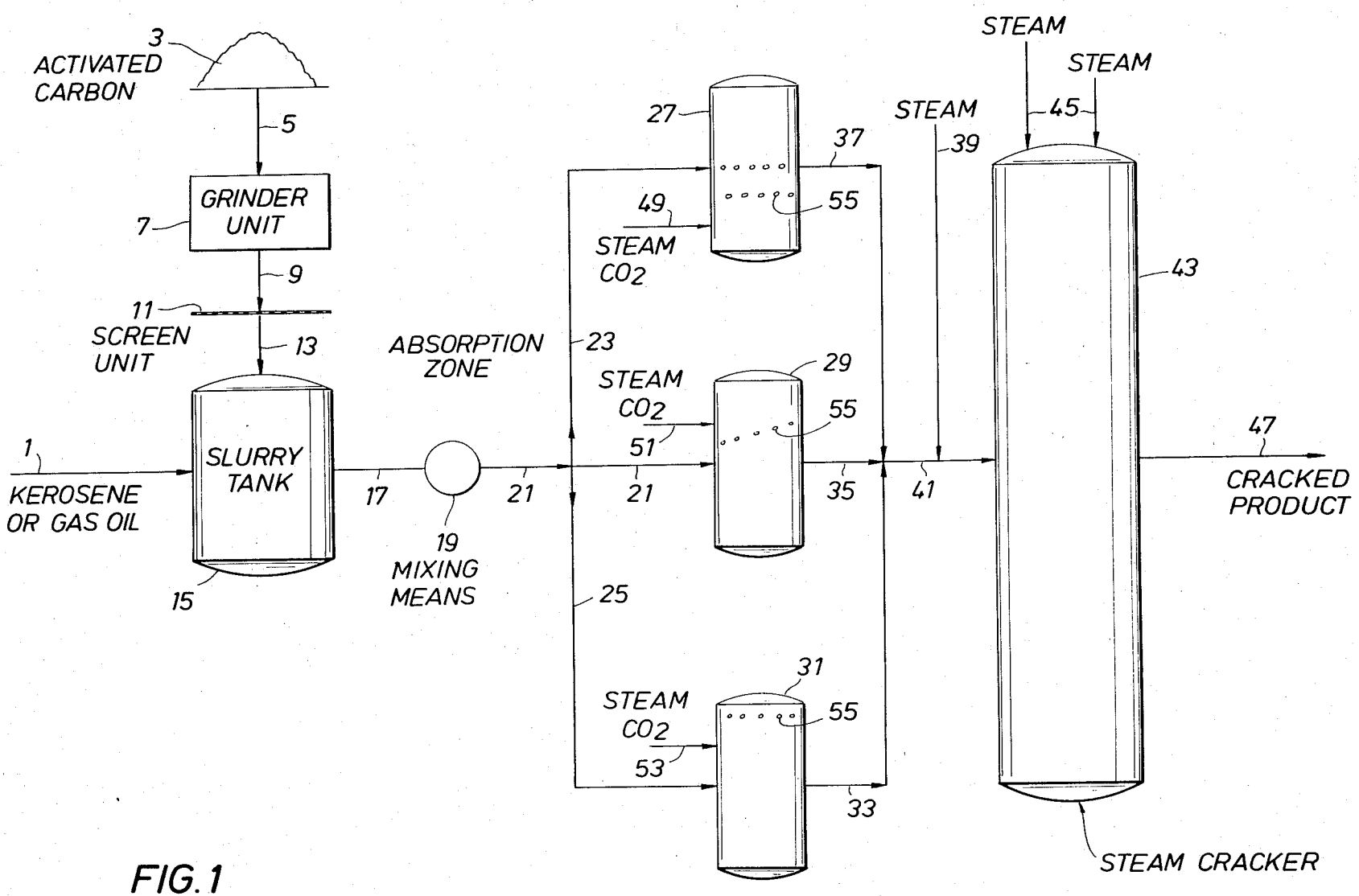
FIG. 1 is a flow scheme of the instant process with all ancilliary accouterments, such as process control valves, instrumentation pumps, condensers and the like having been removed for the sake of simplicity.

In this invention, a slurry of fine particulate activated carbon is formed in slurry mix tank 15 by means of passing a liquid gas oil or kerosene in a heated state through conduit 1 in addition to fine particulate activated carbon to slurry mix tank 15 by means of conduit 13. The latter can, if desired, be derived by beginning with carbon 3, either in a raw natural state or which has been treated to activate the surface thereof, and by passing same in conduit 5 to grinder unit 7. If the activated carbon has been pre-sized, it is not necessary to include grinder unit 7. After desired grinding to a set specification size, the activated carbon is passed through conduit 9 to a preliminary screening unit 11 to excise all activated carbon particles not within the important size variation of 4 mesh to 50 mesh. In the slurry mix tank, a slurry of gas oil or kerosene and activated carbon begins admixture and is thereafter passed after a very short residence time, through conduit 17 to thorough mixing means 19.

It is within the scope of this invention to combine slurry tank 15 with mixing means 19 if the capital expenditures so dictate. The mixing means usually comprises a tank of substantial volume with an agitation means therein to ensure adequate contact of the gas oil or kerosene with the activated fine carbon particles. In this manner, the aromatic and polynuclear aromatic compounds in the gas oil or kerosene will more readily be sorbed by the activated carbon particles. After a short residence time of from 1 to 5 minutes in the mixing means, the slurry containing the gas oil or kerosene and the activated carbon particles with the aromatics sorbed thereon are passed through conduit 21 to physical separation zone 29. The separation zone usually comprises a physical separation means such as a wire screen or filter sieve having apertures 55 situated therein. These apertures are selectively sized to permit the gas oil or kerosene to elute through the filter while prohibiting deactivated carbon particles from safe passage to the steam cracker.

Once separation zone 29 becomes clogged with carbon particles having aromatics sorbed thereon, the slurry is then passed in another direction via conduit 23 or conduit 25 to respective alternative physical separation zones 27 and 31. These zones operate in a manner similar to separation zone 29 wherein apertures 55 render easy excising of the activated carbon particles. During the passage through conduits 23 or 25, the spent or clogged separation zone or filter 29 can be regenerated by means of steam and/or carbon dioxide accessable by means of conduit 51. It is contemplated that these two entities can be added together or the same can be added in separate conduits (not shown). In a like manner, regeneration of screen units 27 and 31 can be undertaken through the use of steam/carbon dioxide entry points 49 and 53. The effluent egressing from the respective separation zones 29, 27, and 31 is passed into conduits 37, 35, and 33, all of which contain gas oil or kerosene hydrocarbon fraction having a decreased amount of aromatic compounds. These streams are passed through feed stock charge conduit 41 to steam cracker unit 43 in admixture with, if desired, steam derived from conduit 39. It is also contemplated that steam may be added to the steam cracking unit in conduit 45. An olefin product derivative of the steam cracking of the gas oil or kerosene is removed in conduit 47 and passed to different process areas of the refinery in order to render the olefins suitable for chemical manufacture or to prepare more gasoline boiling range material.

ILLUSTRATIVE EMBODIMENTS

The illustrative embodiment set forth herein is shown as an exemplary process and should not be construed in any way as an undue limitation thereon.

EXAMPLE 1

A gas oil having a a significant fraction boiling above 615° F. is analyzed by mass spectrometer analysis to determine the content of the aromatic material in the 615°+fraction. This is shown in Table 1 with the negative Z values being equal to the above set forth equation $C_nH_{2n+z}$ such that the higher the negative value the higher the ringed aromatic. Twenty cubic centimeters of the gas oil feed are slurried with 7 grams of activated carbon having a particle size of 4×10 mesh. The slurry continues in existence for approximately five minutes after which the 7 grams of activated carbon is physically filtered from the gas oil. Another mass spectrographic analysis is performed on the gas oil treated with the activated carbon. Table 1 again sets forth the applicable Z numbers which correspond to the Z numbers determined in the non-slurried gas oil.

TABLE 1

| Z Value | Feed | GAC Treated |
|---|---|---|
| +2 | 6.797 | 4.057 |
| 0 | 4.11 | 1.765 |
| −2 | 1.84 | 0.536 |
| −4 | 0.242 | 0.079 |
| −6 | 0.737 | 0.373 |
| −8 | 0.202 | 0.075 |
| −10 | 0.124 | 0.071 |
| −12 | 0.114 | 0.332 |
| −14 | 0.326 | 0.111 |
| −16 | 0.144 | 0.0338 |
| −18 | 0.414 | 0.0158 |
| −20 | 0.125 | 0.0595 |
| −22 | 0.045 | 0.0035 |
| −24 | 0.0035 | 0 |
| −26 | | |
| −28 | | |
| | 16.22 | 7.51 |

As can be clearly seen, use of the activated carbon particles diminished greatly the higher aromatic compounds having many multiple ring structures. For example, all of the Z=−24 (4 or higher ringed aromatics) are removed by the activated carbon particles. The single ring aromatics are nearly halved by the use of the activated carbon particle treatment.

What we claim as our invention:

1. A process for thermal steam cracking in the absence of a catalyst, in a steam cracking zone, of a gas oil having coke precursors contained therein to a hydrocarbon product having smaller molecules which comprises:

(a) passing said gas oil with said coke precursors therein and activated carbon particles to a slurry mix tank at a temperature of from about 10° C. to about 50° C. at slurry forming conditions, wherein said activated carbon particles are present in a particle size of from 4 mesh to about 50 mesh;

(b) slurrying said gas oil with said activated carbon for a period of time sufficient to transfer at least a portion of said coke precursors from said gas oil to said activated carbon;

(c) passing said slurry containing said gas oil of diminished coke precursor content and said activated carbon of enhanced coke precursor content to a separation zone for the physcial separation of said gas oil from said activated carbon; and (d) passing said separated gas oil to said steam cracking zone to crack said gas oil to said hydrocarbon product of smaller molecules in the absence of a catalyst at steam cracking conditions.

2. The process of claim 1 wherein steam cracking conditions include a temperature of about 850° C. to about 1400° C., a pressure of from about 1 atmosphere to about 100 atmospheres and a ratio of steam to hydrocarbon of about 1:1 to about 1:10.

3. The process of claim 1 wherein said activated carbon particles have a mesh size of from about 4 to about 10 mesh.

4. The process of claim 1 wherein said physical separation zone comprises a wire mesh filter screen having apertures therein selective for passage of said gas oil but not passage of said activated carbon particles.

5. The process of claim 4 wherein said perforations are as large as 4 mesh size and as small as 50 mesh size.

6. The process of claim 1 wherein said gas oil has a boiling point greater than kerosene range and a boiling point range less than a lubricating oil.

7. The process of claim 1 wherein said gas oil boils at a range of from about 260° C. to about 600° C.

* * * * *